US008894777B2

(12) United States Patent
Chen

(10) Patent No.: US 8,894,777 B2
(45) Date of Patent: Nov. 25, 2014

(54) SURFACE TREATMENT METHOD OF MAGNESIUM ALLOY ARTICLE AND STRUCTURE THEREOF

(75) Inventor: Chun-Hsiang Chen, Taipei (TW)

(73) Assignee: Getac Technology Corporation, Hsinchu County (TW)

( * ) Notice: Subject to any disclaimer, the term of this patent is extended or adjusted under 35 U.S.C. 154(b) by 507 days.

(21) Appl. No.: 13/244,560

(22) Filed: Sep. 25, 2011

(65) Prior Publication Data

US 2012/0125487 A1 May 24, 2012

(30) Foreign Application Priority Data

Nov. 18, 2010 (CN) ..... 2010 1 0565931

(51) Int. Cl.
*C23C 22/57* (2006.01)
*C23C 8/10* (2006.01)

(52) U.S. Cl.
USPC ..... 148/285; 148/275; 148/276; 148/277; 148/284

(58) Field of Classification Search
CPC ..... C23C 22/57
USPC ..... 148/275–277, 284–285
See application file for complete search history.

(56) References Cited

U.S. PATENT DOCUMENTS

| | | | | |
|---|---|---|---|---|
| 7,385,806 | B2 | 6/2008 | Liao | |
| 2005/0106403 | A1* | 5/2005 | Yui | 428/469 |
| 2011/0097573 | A1* | 4/2011 | Okuda et al. | 428/336 |

FOREIGN PATENT DOCUMENTS

| | | | | |
|---|---|---|---|---|
| CN | 1786270 | A | 6/2006 | |
| CN | 101412065 | A | 4/2009 | |
| CN | 101646322 | A | 2/2010 | |
| CN | 101845656 | A | 9/2010 | |
| TW | M342001 | | 10/2008 | |
| WO | WO 2010/079534 | * | 7/1910 | C23C 26/00 |

* cited by examiner

*Primary Examiner* — Lois Zheng

(57) ABSTRACT

A surface treatment method of a magnesium alloy article includes, instead of forming a primer on a magnesium alloy based composite first, directly performing a hairline finish process on the magnesium alloy based composite, to form a hairline structure on a surface of the magnesium alloy based composite, and performing a chemical oxidation process on the magnesium alloy based composite, to form a glossy film covering the hairline structure on the magnesium alloy based composite, thereby forming a magnesium alloy article structure. Alternatively, another chemical oxidation process is performed before the hairline finish process, to form an oxide film on the surface of the magnesium alloy based composite.

11 Claims, 9 Drawing Sheets

SURFACE TREATMENT METHOD OF MAGNESIUM ALLOY ARTICLE AND STRUCTURE THEREOF

BACKGROUND OF THE INVENTION

1. Field of Invention

The present invention relates to a surface treatment method, and particularly to a surface treatment method of a magnesium alloy article and a structure thereof, which are applicable in a hairline finish process.

2. Related Art

Currently, a casing of an electronic product such as notebook computer, mobile phone, and personal digital assistant (PDA) is mostly made of a plastic material, which has poor visual aesthetics and contact sense. Therefore, casings of the electronic devices made of metal materials are used by some manufacturers, such that metal texture is generated on the appearance of the product, and the aesthetics and contact sense are improved.

With a notebook computer as an example, in order to meet the demands of light, thin, high strength, and good heat dissipation, the casing of the notebook computer is generally made of light metal materials such as magnesium (Mg) alloy, aluminum (Al) alloy, magnesium-aluminum (Mg—Al) alloy, titanium (Ti) alloy, and magnesium-titanium (Mg—Li) alloy. The light metals are molded into the casing of the computer generally by compression molding and injection molding, which is combined with subsequent surface treatment process such as coating and baking, plating, and anode processing, to fabricate a metal casing having desired appearance texture.

Among the light metal materials, the magnesium alloy has numerous excellent material properties, is generally accepted as the most potential light weight material, and has been widely used in 3C electronic products. Due to the limitation of the material property of the melted magnesium alloy, poor surface quality of the molded magnesium alloy work piece is caused, so that the appearance texture and the contact sense of the casing of the electronic device are not good. Therefore, after molding, the magnesium alloy work piece further needs to be performed with some subsequent processes such as hole puttying, grinding, and polishing, and thus time and labor are consumed, and the original metal color texture cannot be directly exhibited.

In order to eliminate the limitation of the magnesium alloy material, an improved process is developed at present. According to a conventional improved process, the magnesium alloy work piece after molding must be puttied, and a layer of primer is sprayed on the surface of the magnesium alloy work piece. Only after the repair process step, a hairline finish processing is performed on the surface of the magnesium alloy work piece clad with the primer, and then a coating layer having metal ingredients such as nano lacquer is coated on the surface of the magnesium alloy work piece after the hairline finish processing, such that the surface of the magnesium alloy work piece will exhibit a metal texture and color.

Although the conventional surface treatment process addresses the problem that the appearance of the magnesium alloy work piece must have metal texture, as a layer of primer is clad on the surface of the magnesium alloy work piece in advance, the hairline finish processing is practically performed on the primer, instead of the magnesium alloy work piece itself. Moreover, after the hairline finish processing, multiple polishing processing procedures such as coating of nano lacquer must be performed, thus resulting in limitations such as too complicated magnesium alloy surface treatment procedures and too high manufacturing cost.

SUMMARY OF THE INVENTION

In view of the problems above, the present invention is a surface treatment method of a magnesium alloy article and a structure thereof, so as to eliminate the limitation that a conventional surface treatment procedure of a magnesium alloy is actually not a surface treatment on the magnesium alloy article itself, and solve the problems that the conventional surface treatment procedures of the magnesium alloy article are too complicated and the manufacturing cost is too high.

The surface treatment method of the magnesium alloy article of the present invention comprises the following steps. A magnesium alloy based composite without a primer on a surface thereof is provided first, and a hairline finish process is directly performed on the magnesium alloy based composite, to form at least one hairline micro-structure on a surface of the magnesium alloy based composite. Finally, a first chemical oxidation process is performed on the magnesium alloy based composite, to form a glossy film covering the hairline micro-structure on the surface of the magnesium alloy based composite. The glossy film is defined as a surface protection film of the hairline micro-structure, and is used for maintaining the glossiness of the surface of the magnesium alloy based composite.

Before the hairline finish process, the surface treatment method of the magnesium alloy article of the present invention may further comprises: performing a second chemical oxidation process on the magnesium alloy based composite, to form an oxide film on the surface of the magnesium alloy based composite, and the hairline micro-structure penetrates through the oxide film, and is formed on the surface of the magnesium alloy based composite.

According to the surface treatment method of the magnesium alloy article of the present invention, the step of performing the first chemical oxidation process on the magnesium alloy based composite further comprises: performing a degreasing procedure on the magnesium alloy based composite; performing a first water washing procedure on the magnesium alloy based composite after the degreasing procedure; performing a second water washing procedure on the magnesium alloy based composite after the first water washing procedure; performing a chemical oxidation procedure on the magnesium alloy based composite after the second water washing procedure; performing a third water washing procedure on the magnesium alloy based composite after the chemical oxidation procedure; performing a deionized water washing procedure on the magnesium alloy based composite after the third water washing procedure; and finally, performing a baking procedure on the magnesium alloy based composite after the deionized water washing procedure, to form the glossy film.

The magnesium alloy article structure of the present invention comprises a magnesium alloy based composite, at least one hairline structure, and a glossy film. The magnesium alloy based composite has a surface without a primer disposed thereon, the hairline structure is formed on a surface of the magnesium alloy based composite, the glossy film is disposed on the surface of the magnesium alloy based composite, and covers the hairline structure. The glossy film is defined as a surface protection film of the hairline structure, and used for maintaining the glossiness of the surface of the magnesium alloy based composite.

The magnesium alloy article structure of the present invention may further comprise an oxide film, disposed on the surface of the magnesium alloy based composite, and located between the magnesium alloy based composite and the glossy film, and the hairline structure penetrates through the oxide film, and is formed on the surface of the magnesium alloy based composite.

According to the surface treatment method of the present invention, the hairline structure is directly formed on the surface of the magnesium alloy article, and thus the process of the surface treatment is simplified, and the manufacturing cost of the surface treatment process is reduced.

In addition, according to the surface treatment method of the present invention, the glossy film covering the hairline structure is formed, which can not only provide an anti-oxidization effect, but also maintain or increase the glossiness of the surface of the magnesium alloy article, such that the confidence level upon ex factory inspection is improved, and the magnesium alloy article has a beautiful shape as desired in the market.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION OF THE INVENTION

The magnesium alloy article of the present invention is used as a casing of various electronic devices, and the electronic devices comprise, but are not limited to, electronic devices requiring beautiful appearance such as notebook computer, PDA Phone or Smart Phone, Portable Navigation Device (PND), and Personal Digital Assistant (PDA). In the detailed description of the present invention below, a notebook computer is taken as an optimal embodiment of the present invention. However, the accompanying hairlines are provided for reference and illustration, instead of limiting the present invention.

Figure 1:
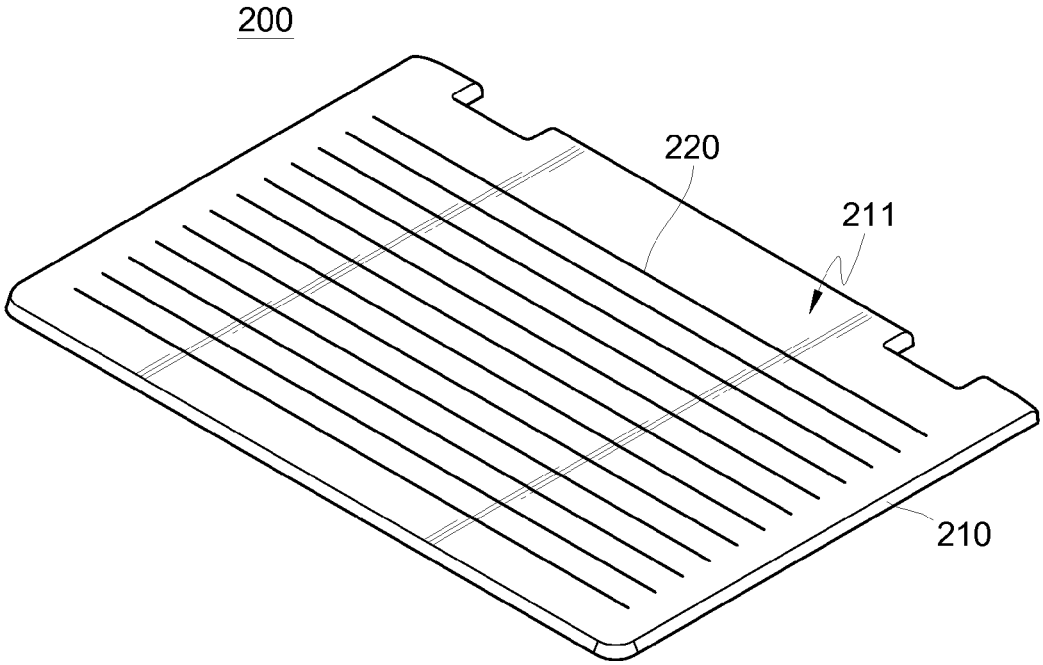
FIG. 1 is a schematic three-dimensional view of a magnesium alloy article according to the present invention.
Figure 2A:
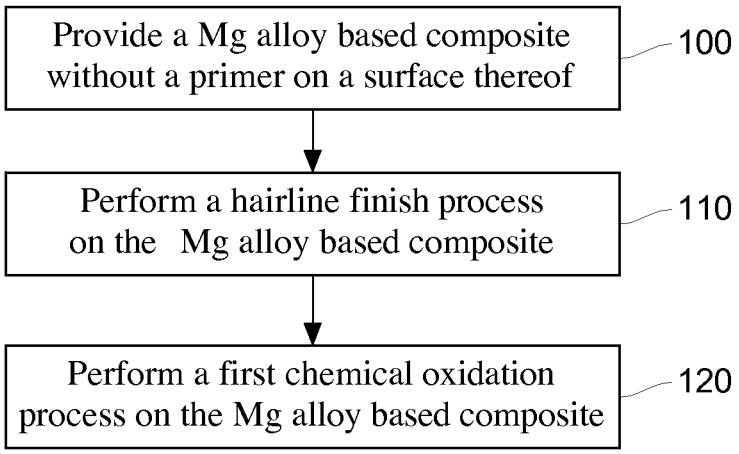
FIG. 2A is a step flow chart according to a first embodiment of the present invention.
Figure 2B:
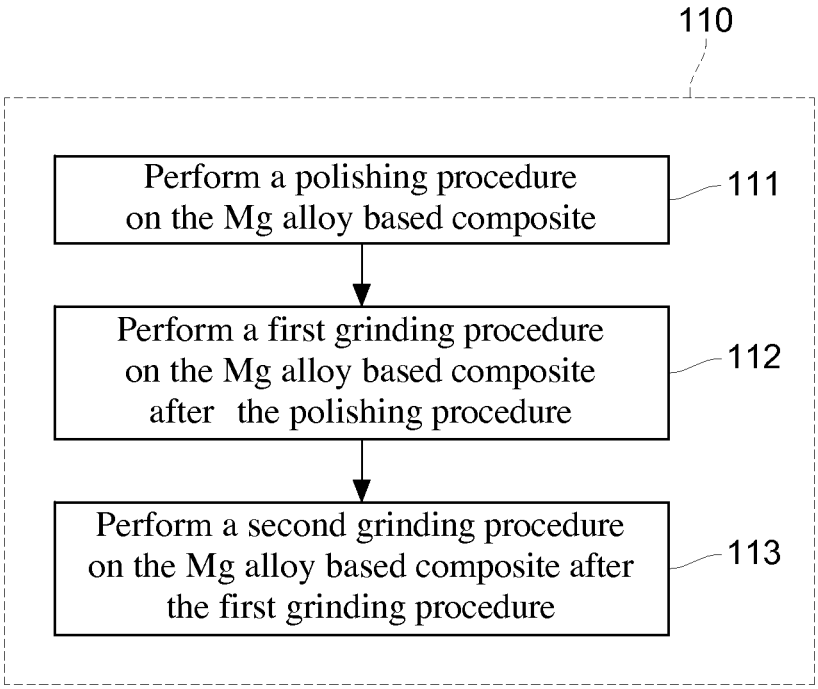
FIG. 2B is a step flow chart of a hairline finish process according to the first embodiment of the present invention.
Figure 2C:
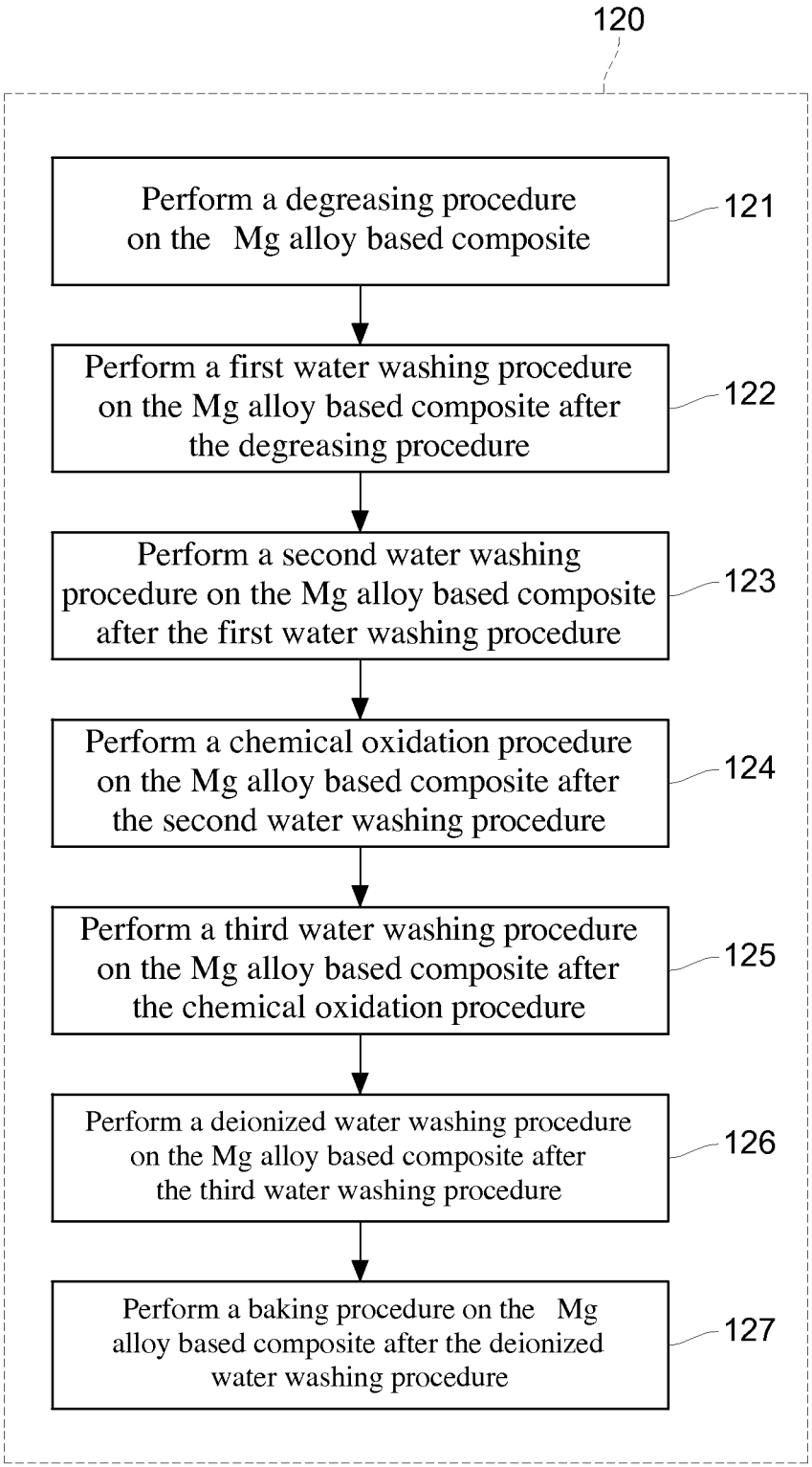
FIG. 2C is a step flow chart of a first chemical oxidation process according to the first embodiment of the present invention.
Figure 3:
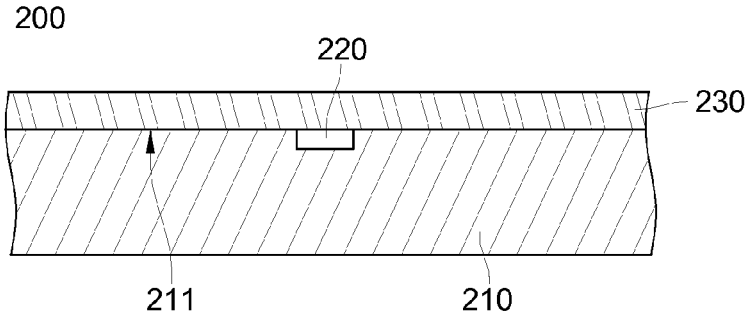
FIG. 3 is a planar cross-sectional view of a magnesium alloy article according to the first embodiment of the present invention.

FIG. 1 is a schematic three-dimensional view of a magnesium alloy article of the present invention, FIGS. 2A to 2C are step flow charts according to a first embodiment of the present invention, and FIG. 3 is a planar cross-sectional view of a magnesium alloy article according to the first embodiment of the present invention.

As shown in the figures, a surface treatment method of a magnesium alloy article 200 according to the first embodiment of the present invention comprises the following steps. A magnesium alloy based composite 210 is provided first, which has a surface 211, for example, an outer surface, and the surface 211 of the magnesium alloy based composite 210 does not have a primer pre-formed thereon in the prior art (Step 100). The magnesium alloy based composite 210 of the present invention may be fabricated by compression molding or injection molding. Then, a cutting and machining procedure, and a computer numeric control (CNC) machining procedure are performed on the magnesium alloy based composite 210, to form the magnesium alloy based composite 210 with a preset size and shape.

Then, a hairline finish process (Step 110) is directly performed on the magnesium alloy based composite 210 which has been machined, to form at least one hairline structure 220 on the surface 211 of the magnesium alloy based composite 210, and the hairline structure 220 is directly formed on the magnesium alloy based composite 210.

The details of the hairline finish process (Step 110) for the magnesium alloy based composite is further described in detail. First, a polishing procedure (Step 111) is performed on the magnesium alloy based composite 210, in which the polishing procedure is first performed on irregular parts, for example, edges and corners of the magnesium alloy based composite 210, to form the hairline structure 220 on the irregular parts of the magnesium alloy based composite 210. In the polishing procedure of this embodiment, the irregular parts of the magnesium alloy based composite 210 may be polished by using a wool grinding wheel or a nylon grinding wheel, but the present invention is not limited thereto.

Next, a first grinding procedure (Step 112) is performed on the magnesium alloy based composite 210 after the polishing procedure, and finally a second grinding procedure (Step 113) is performed on the magnesium alloy based composite 210 after the first grinding procedure.

In the first grinding procedure and the second grinding procedure of this embodiment, a two-stage hairline finish processing is performed on a large-area part of the magnesium alloy based composite 210, for example, the surface 211 of the magnesium alloy based composite 210 by using an abrasive belt machine, and the hairline finish processing may be manually or automatically performed on the magnesium alloy based composite 210 by an operator, but the present invention is not limited thereto. In addition, a grit size of the abrasive belt used in the first grinding procedure is relatively greater than that of the abrasive belt used in the second grinding process, such that a crude hairline finish process is first performed on the surface of the magnesium alloy based composite 210, to remove the flow traces on the surface of the magnesium alloy based composite 210, and then a fine hairline finish process is performed, to form a regular hairline structure 220 without other unnecessary traces or patterns, thereby improving the hairline quality of the surface 211 of the magnesium alloy based composite 210.

For example, in this embodiment, the grit size of the abrasive belt used in the first grinding procedure is below 100#, and the grit size of the abrasive belt used in the second grinding procedure is above 100#. However, it is known to persons skilled in the art that the grit size of the abrasive belts used in the first grinding procedure and the second grinding procedure may be changed according to practical demands, and are not limited to the embodiments disclosed in the present invention.

Referring to FIGS. 2A, 2B, 2C, and 3, after the hairline finish process (Step 110), a first chemical oxidation process (Step 120) is then performed on the magnesium alloy based composite 210, to form a glossy film 230 on the surface 211 of the magnesium alloy based composite 210, and the glossy film 230 completely covers the hairline structure 220, to form the magnesium alloy article 200 having a hairline surface.

In this embodiment, the glossy film 230 may be, but is not limited to, a colored chemical coating or a colorless and transparent chemical coating, and a manufacturer may adjust the brightness and color exhibited by the glossy film 230 according to practical demands. Moreover, the glossy film 230 is formed on the surface 211 of the magnesium alloy based composite 210 through multiple chemical procedures performed on the magnesium alloy based composite 210. The magnesium alloy article 200 of the present invention has the glossy film 230 covering the hairline structure 220, thus serving as a surface protection film of the hairline structure 220, and the glossy film 230 can not only provide an anti-oxidation effect, to prevent the oxidation reaction of the magnesium alloy article 200 with external atmosphere, but also maintain or increase the glossiness of the surface of the magnesium alloy article 200. Furthermore, the glossy film 230 makes the magnesium alloy article 200 have good conductivity.

After practical glossiness test, a numerical difference between the glossiness of the magnesium alloy based composite 210 formed with the glossy film 230 of the present invention and the glossiness of the magnesium alloy based composite 210 without the glossy film 230 is greater than or equal to zero. Moreover, the numerical difference between the glossiness of the magnesium alloy based composite 210 formed with the glossy film 230 of the present invention and the glossiness of the magnesium alloy based composite 210 without the glossy film 230 is at least 0.7 gloss unit (GU). Apparently, the glossy film 230 of the present invention definitely provides an effect of maintaining or increasing the surface glossiness of the magnesium alloy article 200.

Referring to FIG. 2C, for example, the first chemical oxidation process (Step 120) of the present invention comprises immersing the magnesium alloy based composite 210 in multiple chemical tanks in sequence for performing the chemical oxidation processing.

Specifically, the first chemical oxidation process (Step 120) in this embodiment may comprise the following steps. A degreasing procedure (Step 121) is first performed on the magnesium alloy based composite 210, to remove ester substances (for example, chemical substances such as cutting fluid and release agent) remained on the surface 211 of the magnesium alloy based composite 210, so as to prevent the influence of the ester substances on the subsequent chemical processing procedures. Next, a first water washing procedure (Step 122) is performed on the magnesium alloy based composite 210 after the degreasing procedure, and a second water washing procedure (Step 123) is performed on the magnesium alloy based composite 210 after the first water washing procedure.

Subsequently, a chemical oxidation procedure (Step 124) is performed on the magnesium alloy based composite 210 after the second water washing procedure, to form a complete glossy film 230 on the surface 211 of the magnesium alloy based composite 210. Afterwards, a third water washing procedure (Step 125) is performed on the magnesium alloy based composite 210 after the chemical oxidation procedure, and then, a deionized water washing procedure (Step 126) is performed on the magnesium alloy based composite 210 after the third water washing procedure, to clean the glossy film 230 formed on the surface 211 of the magnesium alloy based composite 210 with pure water, and finally a baking procedure (Step 127) is performed on the magnesium alloy based composite 210 after the deionized water washing procedure, to ensure that no water is remained on the glossy film 230, so as to facilitate the performing of the subsequent process steps.

In the implementation of the first chemical oxidation process of the present invention, the chemical oxidation of the glossy film 230 is performed by using an aluminium coating agent of model GT-003 available from Shanghai Shangpin Co., Ltd.; using an ultra microemulsified resin available from Makin Technology Co., Ltd. as the reagent used in the first chemical oxidation process; using a reagent of Model MG-15SX or MC-1620 available from Nihon Parkerizing Co., Ltd., Japan in the first chemical oxidation process of the present invention; or using a reagent of Model N6020R or N7111 available from Shanghai Peacco Co., Ltd. in the first chemical oxidation process of the present invention.

However, persons skilled in the art can correspondingly adjust the step order of the first chemical oxidation process according to different parameter conditions and process procedures, or correspondingly increase or decrease the procedure number of the first chemical oxidation process, and correspondingly adjust the reagent used in the chemical oxidation process, and the present invention is not limited to the process step order and the reagent species disclosed in this embodiment.

Figure 4A:
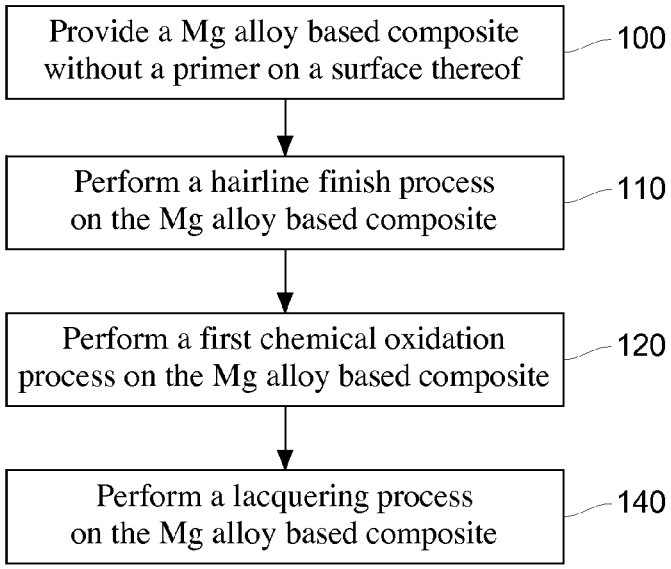
FIG. 4A is a step flow chart according to a second embodiment of the present invention.
Figure 4B:
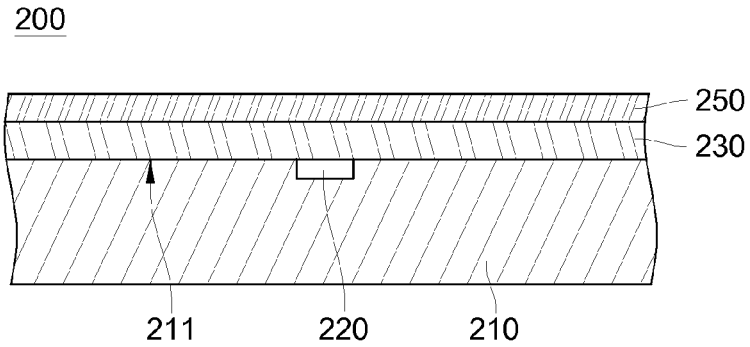
FIG. 4B is a planar cross-sectional view of a magnesium alloy article according to the second embodiment of the present invention.

FIG. 4A is a step flow chart according to a second embodiment of the present invention, and FIG. 4B is a planar cross-sectional view of a magnesium alloy article according to the second embodiment. As the process steps of the second embodiment are substantially identical to those of the first embodiment, description is made only with reference to differences therebetween.

As shown in FIGS. 4A and 4B, after the first chemical oxidation process (Step 120) of the magnesium alloy based composite 210, the second embodiment of the present invention further comprises a process step of performing at least one pass of lacquering process (Step 140) on the magnesium alloy based composite 210, thereby forming at least one lacquer layer 250 on the glossy film 230, so as to further provide an appearance beautifying effect to the magnesium alloy article 200.

In this embodiment, the lacquering process (Step 140) may be performed only one pass. A resin material may be coated on the glossy film 230 to form a primer layer on the glossy film 230 by, for example, spraying, knife coating, screen printing, physical vapor deposition (PVD), chemical vapor deposition (CVD), electrodeposition (ED), thermal transfer, water transfer, and electrophoresis, and this lacquer layer 250 may be a colorless and transparent film layer, or a white film layer. Alternatively, the lacquering process (Step 140) of this embodiment may be performed only with two passes. A colorless and transparent film layer, or a white film layer is first formed on the glossy film 230 with, for example, a resin material by spraying, knife coating, screen printing, PVD, CVD, ED, thermal transfer, water transfer, and electrophoresis, and then the lacquering process is repeated on the primer layer, to overlap a colored finish coating layer on the primer layer, so as to improve the appearance beautifying effect of the magnesium alloy article 200. In this embodiment, the number of the lacquer layer 250 may be changed with the lacquering process according to practical demand; and the present invention is not limited thereto.

Figure 5A:
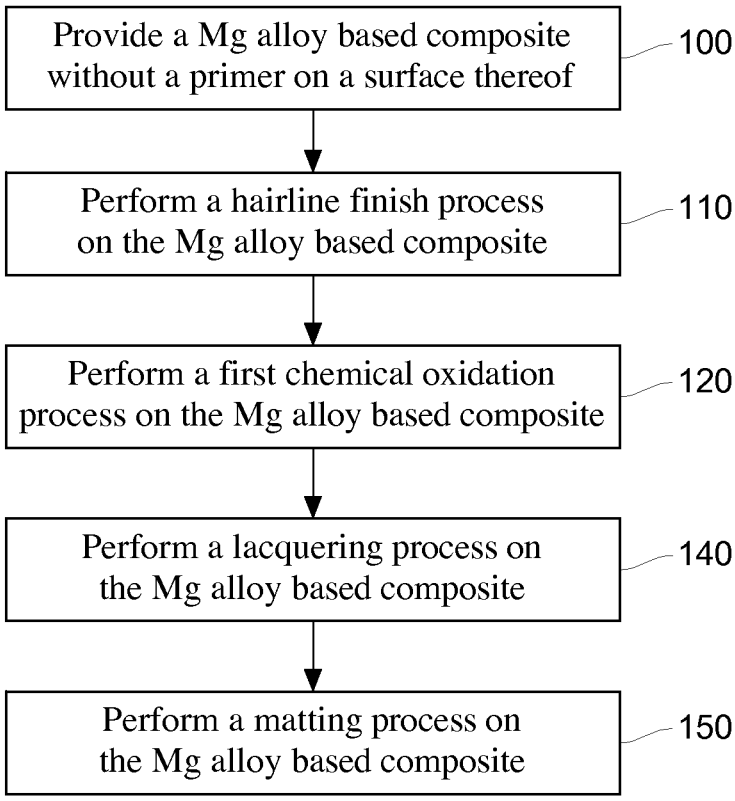
FIG. 5A is a step flow chart according to a third embodiment of the present invention.
Figure 5B:
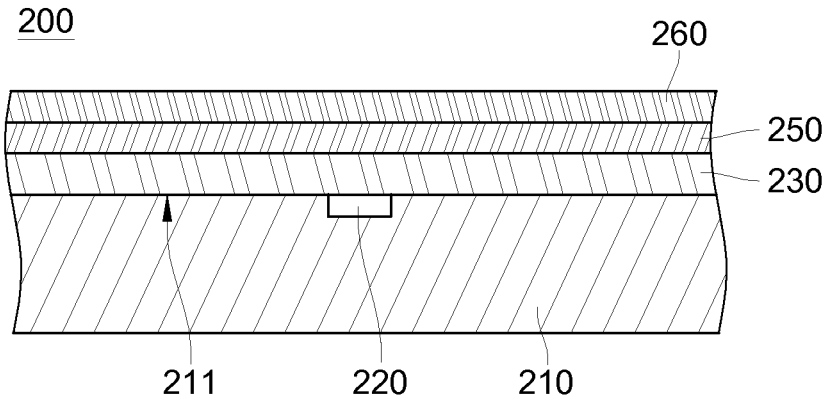
FIG. 5B is a planar cross-sectional view of a magnesium alloy article according to the third embodiment of the present invention.

FIG. 5A is a step flow chart according to a third embodiment of the present invention; and FIG. 5B is a planar cross-sectional view of a magnesium alloy article according to the third embodiment of the present invention. As the process steps and structure of the third embodiment are substantially identical to those of the second embodiment, description is made only with reference to differences therebetween.

As shown in FIGS. 5A and 5B, after the lacquering process (Step 140) of the magnesium alloy based composite 210, the third embodiment of the present invention further comprises a process step of performing an matting process (Step 150) on the magnesium alloy based composite 210, to form an matt film 260 on the lacquer layer 250. In this embodiment, the matt film 260 may be a colorless and transparent film layer, or the color of the matt film 260 is changed to be various colors such as red and black according to practical application demands, but the present invention is not limited thereto.

In this embodiment, the matt film 260 further provides an appearance beautifying effect to the magnesium alloy article 200, and provides a more perfect oxidation protection effect to the magnesium alloy based composite 210, so as to isolate the magnesium alloy based composite 210 from external atmosphere environment.

Specifically, in the third embodiment, the matting process (Step 150) comprises applying a matting agent such as a matting clear coat and a ultraviolet (UV) lacquer on the lacquer layer 250 by spraying, knife coating, screen printing, PVD, CVD, ED, thermal transfer, water transfer, and electrophoresis, to form the matt film 260. The glossy film 230 of the present invention not only provides anti-oxidation effect, maintains or even greatly increases the surface glossiness of the magnesium alloy article, and improves the conductivity, but also makes the matting agent applied in the subsequent matting process have good adhesion property as far as the matting process of this embodiment is concerned, such that the matt film 260 is flatly clad on the glossy film 230.

Figure 6A:
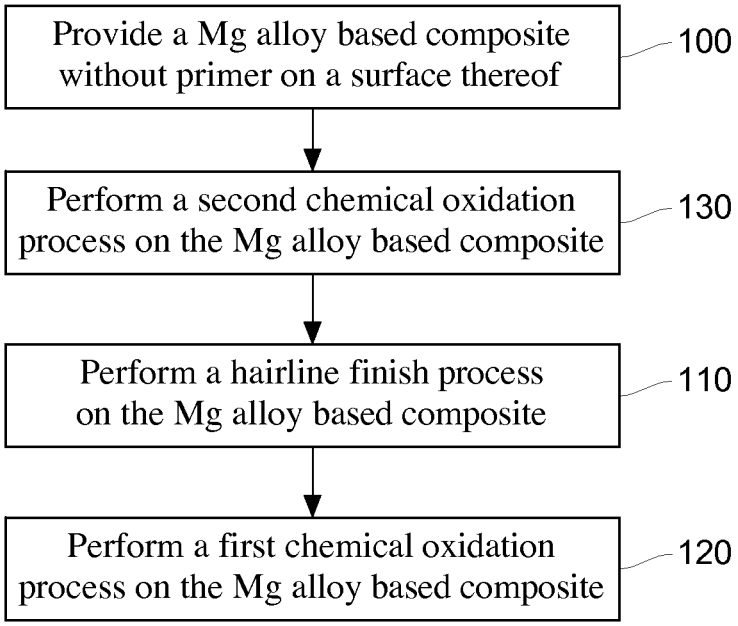
FIG. 6A is a step flow chart according to a fourth embodiment of the present invention.
Figure 6B:
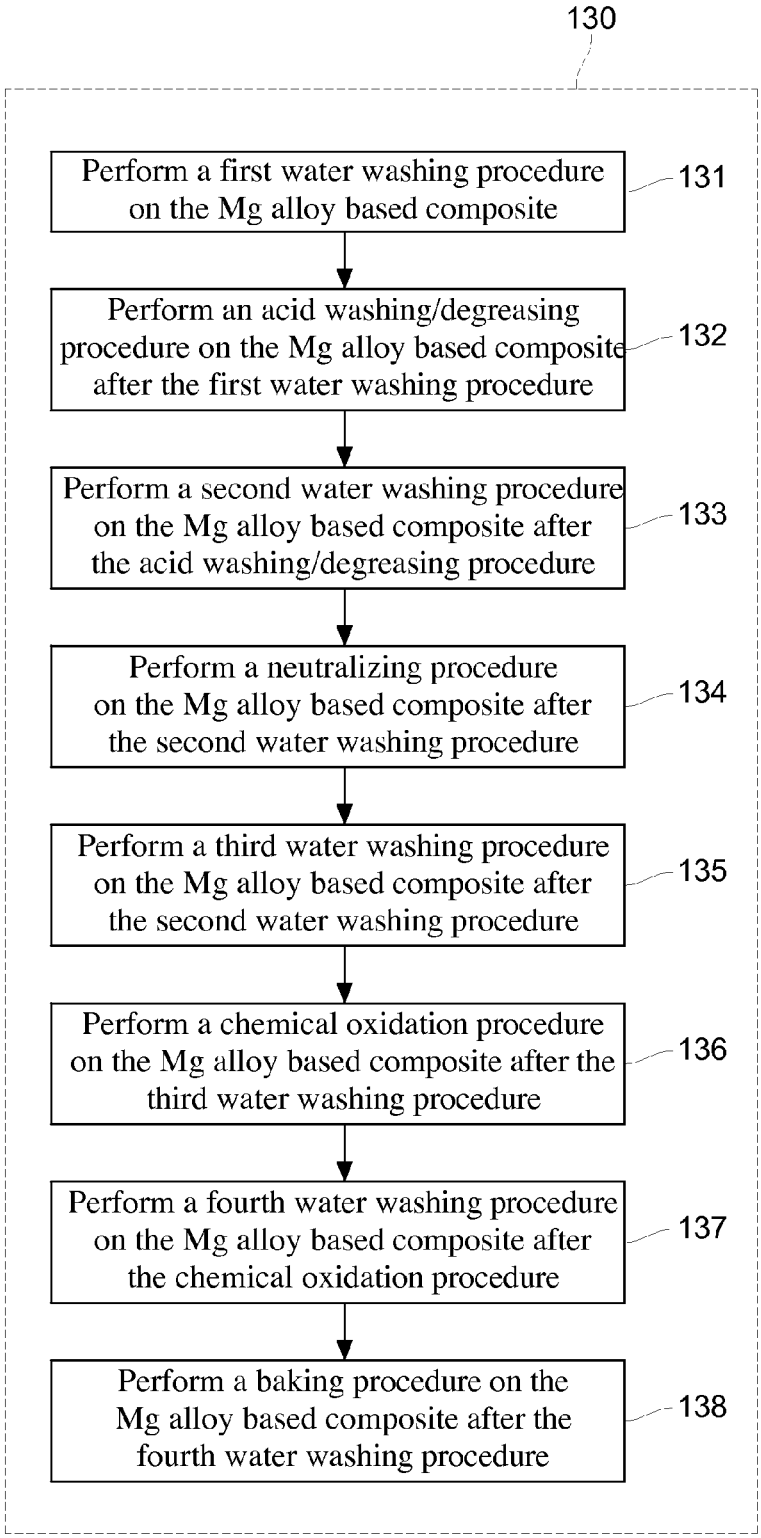
FIG. 6B is a step flow chart of a second chemical oxidation process according to the fourth embodiment of the present invention.
Figure 6C:
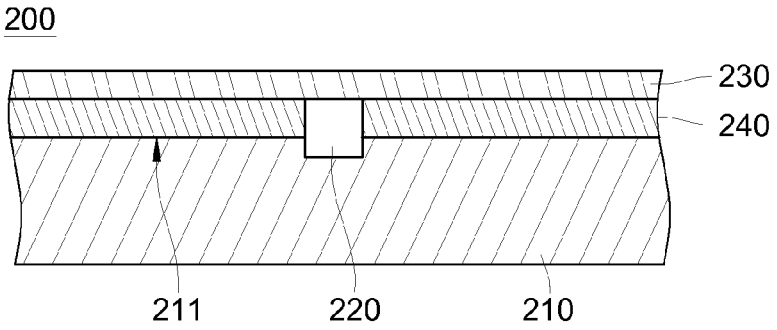
FIG. 6C is a planar cross-sectional view of a magnesium alloy article according to the fourth embodiment of the present invention.

FIGS. 6A and 6B are a step flow chart according to a fourth embodiment of the present invention, and FIG. 6C is a planar cross-sectional view of a magnesium alloy article according to the fourth embodiment of the present invention.

As shown in the figures, a surface treatment method of a magnesium alloy article 200 according to the fourth embodiment of the present invention comprises the following steps. A magnesium alloy based composite 210 is provided first, which has a surface 211, for example, an external surface, and the surface 211 of the magnesium alloy based composite 210 does not have a primer pre-formed thereon like the prior art (Step 100). The magnesium alloy based composite 210 of the present invention may be fabricated by compression molding or injection molding. Then, a cutting and machining procedure, and a computer numeric control (CNC) machining procedure are performed on the magnesium alloy based composite 210, to form the magnesium alloy based composite 210 with a preset size and shape.

Then, a second chemical oxidation process is performed on the thus machined magnesium alloy based composite 210, to form an oxide film 240, which is clad on the surface 211 of the magnesium alloy based composite 210 (Step 130), so as to effectively protect the magnesium alloy based composite 210, and prevent the oxidation of the magnesium alloy based composite 210.

Referring to FIG. 6B, in combination with FIGS. 6A and 6C, for example, the second chemical oxidation process (Step 130) of this embodiment comprises immersing the magnesium alloy based composite 210 in multiple chemical tanks in sequence for performing the chemical oxidation processing.

Specifically, the second chemical oxidation process (Step 130) of this embodiment may comprise the following steps. A first water washing procedure (Step 131) is first performed on the magnesium alloy based composite 210, and an acid washing/degreasing procedure (Step 132) is performed on the magnesium alloy based composite 210 after the first water washing procedure, to remove acid ester substances (for example, chemical substances such as cutting fluid and release agent) remained on the surface 211 of the magnesium alloy based composite 210, so as to prevent the influence of the acid ester substances on the subsequent chemical processing procedures. Next, a second water washing procedure (Step 133) is performed on the magnesium alloy based composite 210 after the acid washing/degreasing procedure, and a neutralizing procedure (Step 134) is performed on the magnesium alloy based composite 210 after the second water washing procedure, such that the surface of the magnesium alloy based composite 210 is kept at a neutral pH value.

Subsequently, a third water washing procedure (Step 135) is performed on the magnesium alloy based composite 210 after the neutralizing procedure. A chemical oxidation procedure (Step 136) is performed on the magnesium alloy based composite 210 after the third water washing procedure, to form a complete oxide film 220 on the surface 211 of the magnesium alloy based composite 210, so as to prevent the oxidation reaction of the magnesium alloy article with external atmosphere. Afterwards, a fourth water washing procedure (Step 137) is performed on the magnesium alloy based composite 210 after the chemical oxidation procedure, to clean the oxide film 220 formed on the surface 211 of the magnesium alloy based composite 210 with pure water, and finally a baking procedure (Step 138) is performed on the magnesium alloy based composite 210 after the fourth water washing procedure, to ensure that no water is remained on the oxide film 220, so as to facilitate the performing of the subsequent process steps.

It should be noted that persons skilled in the art can correspondingly adjust the step order of the second chemical oxidation process, or correspondingly increase or decrease the procedure number of the first chemical oxidation process, according to practical process procedure demands; and the present invention is not limited to the embodiment disclosed herein. Furthermore, the oxide film 240 formed in the second chemical oxidation process may be a colored chemical coating, and the present invention is not limited thereto.

As shown in FIGS. 6A and 6C, after the second chemical oxidation process (Step 130) of the magnesium alloy based composite 210, a hairline finish process (Step 110) is performed on the magnesium alloy based composite 210, to form at least one hairline micro-structure 220 on the surface 211 of the magnesium alloy based composite 210, and this hairline micro-structure 220 penetrates through the oxide film 240 and is formed on the surface 211 of the magnesium alloy based composite 210. That is to say, the hairline micro-structure 220 destroys the structure of the oxide film 240, and then is directly formed on the magnesium alloy based composite 210.

In this embodiment, the hairline finish process (Step 110) of the magnesium alloy based composite is identical to that of the first embodiment, so the details will not be described herein again.

Referring to FIGS. 6A and 6C again, after the hairline finish process (Step 110) of the magnesium alloy based composite 210, a first chemical oxidation process (Step 120) is performed on the magnesium alloy based composite 210, to form a glossy film 230 on the oxide film 240, and the glossy film 230 completely covers the hairline micro-structure 220, to form a magnesium alloy article 200 having a hairline surface.

In this embodiment, the glossy film 230 is a colorless and transparent chemical coating, and is formed on the oxide film 240 through multiple chemical procedures performed on the magnesium alloy based composite 210, and the first chemical oxidation process (Step 120) of the magnesium alloy based composite in this embodiment is identical to that in the first embodiment (referring to FIG. 2C), so the details will not be described herein again. The magnesium alloy article 200 of the present invention has the glossy film 230 covering the hairline micro-structure 220, which can not only provide an anti-oxidation effect, but also maintain or increase the surface glossiness of the magnesium alloy article. Moreover, the glossy film 230 further makes the magnesium alloy article 200 have good conductivity.

After practical glossiness test, a numerical difference between the glossiness of the magnesium alloy based composite 210 formed with the glossy film 230 of the present invention and that of the magnesium alloy based composite 210 without the glossy film 230 is greater than or equal to zero. Moreover, the numerical difference between the glossiness of the magnesium alloy based composite 210 formed with the glossy film 230 of the present invention and that of the magnesium alloy based composite 210 without the glossy film 230 is at least 0.7 GU. Apparently, the glossy film 230 of the present invention definitely provides an effect of maintaining or increasing the surface glossiness of the magnesium alloy article 200.

In the implementation of the first chemical oxidation process of the present invention, chemical oxidation of the glossy film 230 is performed by using an aluminium coating agent of model GT-003 available from Shanghai Shangpin Co., Ltd.; using an ultra microemulsified resin available from Makin Technology Co., Ltd. as the reagent used in the first chemical oxidation process; using a reagent of Model MG-15SX or MC-1620 available from Nihon Parkerizing Co., Ltd., Japan in the first chemical oxidation process of the present invention; or using a reagent of Model N6020R or N7111 available from Shanghai Peacco Co., Ltd. in the first chemical oxidation process of the present invention. However, persons skilled in the art can correspondingly adjust the reagent used in the chemical oxidation process, according to different parameter conditions and process procedures, and the present invention is not limited to the reagent species disclosed in this embodiment.

Figure 7A:
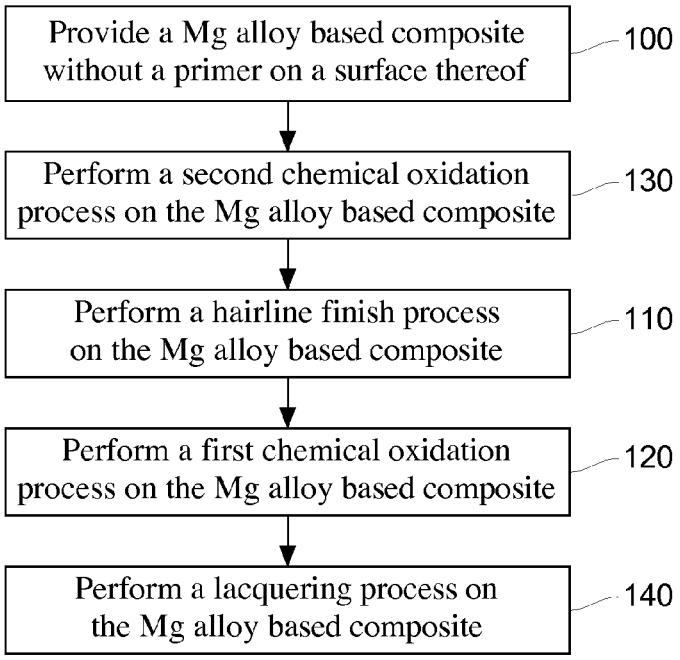
FIG. 7A is a step flow chart according to a fifth embodiment of the present invention.
Figure 7B:
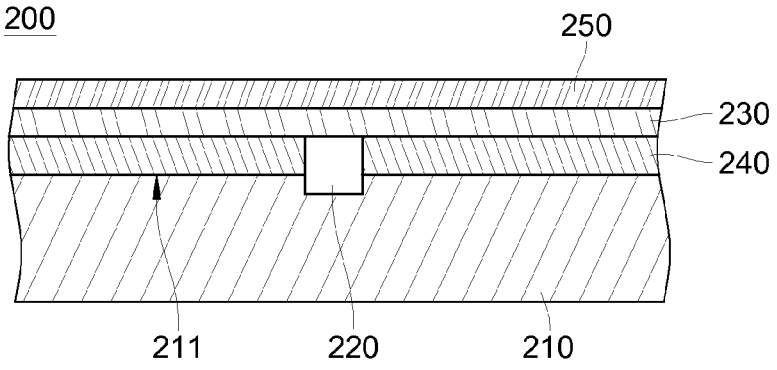
FIG. 7B is a planar cross-sectional view of a magnesium alloy article according to the fifth embodiment of the present invention.

FIG. 7A is a step flow chart according to a fifth embodiment of the present invention, and FIG. 7B is a planar cross-sectional view of a magnesium alloy article according to the fifth embodiment of the present invention. As process steps and structure of the fifth embodiment are substantially identical to those of the fourth embodiment, description is made only with reference to differences therebetween.

As shown in FIGS. 7A and 7B, after the first chemical oxidation process (Step 120) of the magnesium alloy based composite 210, the fifth embodiment of the present invention further comprises a process step of performing at least one pass of lacquering process (Step 140) on the magnesium alloy based composite 210, to form at least one lacquer layer 250 on the glossy film 230, so as to further provide an appearance beautifying effect to the magnesium alloy article 200.

In this embodiment, the lacquering process (Step 140) may be performed only one pass. A resin material may be coated to form a primer layer on the glossy film 230 by, for example, spraying, knife coating, screen printing, PVD, CVD, ED, thermal transfer, water transfer, and electrophoresis, and this lacquer layer 250 may be a colorless and transparent film layer, or a white film layer. Alternatively, the lacquering process (Step 140) of this embodiment may be performed only two passes. A colorless and transparent film layer, or a white film layer is formed on the glossy film 230 with, for example, a resin material by spraying, knife coating, screen printing, PVD, CVD, ED, thermal transfer, water transfer, and electrophoresis, and then the lacquering process is repeated on the primer layer, to overlap a colored finish coat layer on the primer layer, so as to improve the appearance beautifying effect of the magnesium alloy article 200. In this embodiment, the number of the lacquer layer 250 may be changed with the lacquering process according to practical application demand, and the present invention is not limited thereto.

Figure 8A:
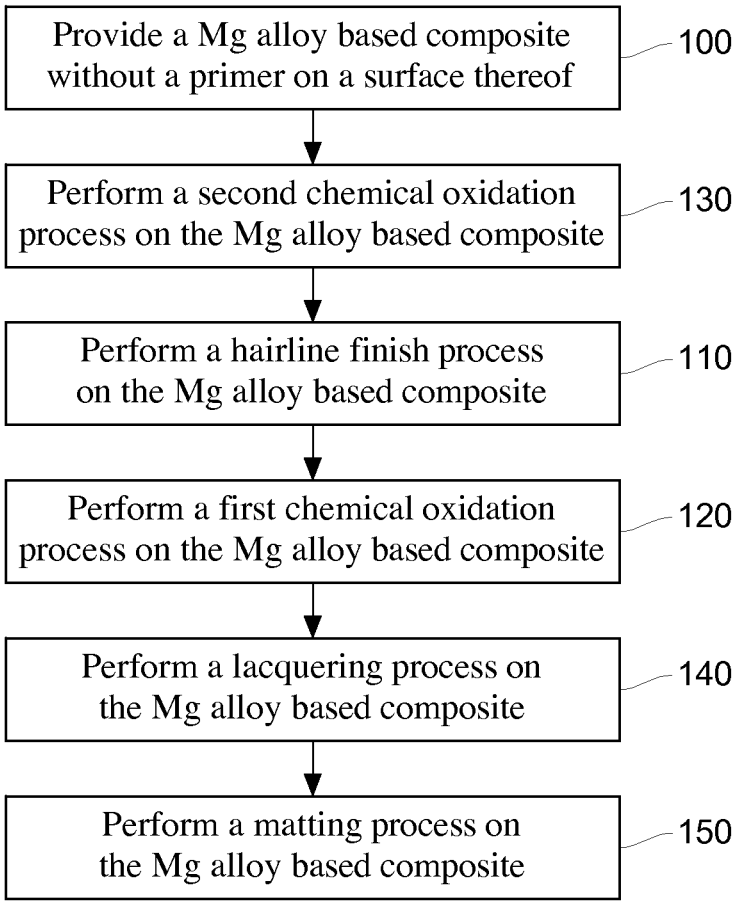
FIG. 8A is a step flow chart according to a sixth embodiment of the present invention.
Figure 8B:
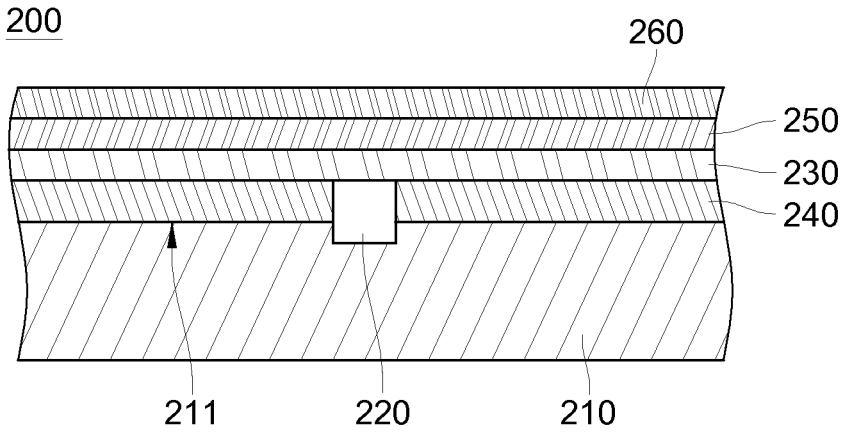
FIG. 8B is a planar cross-sectional view of a magnesium alloy article according to the sixth embodiment of the present invention.

FIG. 8A is a step flow chart according to a sixth embodiment of the present invention, and FIG. 8B is a planar cross-sectional view of a magnesium alloy article according to the sixth embodiment of the present invention. As process steps and structure of the sixth embodiment are substantially identical to those of the fifth embodiment, description is made only with reference to differences therebetween.

As shown in FIGS. 8A and 8B, after the lacquering process (Step 140) of the magnesium alloy based composite 210, the sixth embodiment of the present invention further comprises a process step of performing a matting step (Step 150) on the magnesium alloy based composite 210, to form a matt film 260 on the lacquer layer 250. In this embodiment, the matt film 260 may be a colorless and transparent film layer, or the color of the matt film 260 is changed to be various colors such as red and black according to practical application demands, and the present invention is not limited thereto.

In this embodiment, the matt film 260 further provides an appearance beautifying effect to the magnesium alloy article 200, and provides a more perfect oxidation protection effect to the magnesium alloy based composite 210, so as to isolate the magnesium alloy based composite 210 from external atmosphere environment.

Specifically, in the sixth embodiment, the matting process (Step 150) comprises applying a matting agent such as a matting clear coat, and a UV lacquer on the lacquer layer 250 by spraying, knife coating, screen printing, PVD, CVD, ED, thermal transfer, water transfer, and electrophoresis, to form the matt film 260. The glossy film 230 of the present invention not only provides anti-oxidation effect, maintains or increases the surface glossiness of the magnesium alloy article, and improves the conductivity, but also makes the matting agent applied in the subsequent matting process have good adhesion property as far as the matting process of this embodiment is concerned, such that the matt film 260 is flatly clad on the glossy film 230.

According to the surface treatment method of the magnesium alloy article of the present invention, the hairline finish process is directly performed on a bare magnesium alloy article, to form a hairline structure on the surface of the magnesium alloy based composite. Thus, the process for surface treatment of the magnesium alloy article can be greatly simplified, and the manufacturing cost is saved.

According to the surface treatment method of the present invention, a glossy film is further formed through the chemical oxidation process, and this glossy film not only provides an anti-oxidation effect, but also maintain the original surface glossiness of the magnesium alloy article, or even greatly increase the surface glossiness of the magnesium alloy article, such that the magnesium alloy article has a beautiful appearance as desired in the market, an improved confidence level, and a good conductivity as well. In addition, the glossy film also improves the cladding property of the lacquer layer formed in the subsequent lacquering process to the matt film formed in the matting process.

What is claimed is:

1. A surface treatment method of a magnesium alloy article, comprising:

providing a magnesium alloy based composite without a primer on a surface thereof;

performing a hairline finish process on the magnesium alloy based composite, to form at least one hairline structure on a surface of the magnesium alloy based composite; and performing a first chemical oxidation process on the magnesium alloy based composite, to form a glossy film covering the hairline structure on the surface of the magnesium alloy based composite, wherein the glossy film is defined as a surface protection film of the hairline structure, and is used for maintaining or increasing the glossiness of the surface of the magnesium alloy based composite;

wherein before the hairline finish process, the method further comprises performing a second chemical oxidation process on the magnesium alloy based composite, to form an oxide film on the surface of the magnesium alloy based composite, and the hairline structure penetrates through the oxide film, and is formed on the surface of the magnesium alloy based composite.

2. The surface treatment method of the magnesium alloy article according to claim 1, wherein a difference between the glossiness of the magnesium alloy based composite formed with the glossy film and a magnesium alloy based composite without the glossy film is greater than or equal to zero.

3. The surface treatment method of the magnesium alloy article according to claim 2, wherein the difference between the glossiness of the magnesium alloy based composite formed with the glossy film and the magnesium alloy based composite without the glossy film is at least 0.7 gloss unit (GU).

4. The surface treatment method of the magnesium alloy article according to claim 1, wherein the step of performing the first chemical oxidation process on the magnesium alloy based composite further comprises:

performing a degreasing procedure on the magnesium alloy based composite;

performing a first water washing procedure on the magnesium alloy based composite after the degreasing procedure;

performing a second water washing procedure on the magnesium alloy based composite after the first water washing procedure;

performing a chemical oxidation procedure on the magnesium alloy based composite after the second water washing procedure;

performing a third water washing procedure on the magnesium alloy based composite after the chemical oxidation procedure;

performing a deionized water washing procedure on the magnesium alloy based composite after the third water washing procedure; and performing a baking procedure on the magnesium alloy based composite after the deionized water washing procedure, to form the glossy film.

5. The surface treatment method of the magnesium alloy article according to claim 1, wherein the step of performing the second chemical oxidation process further comprises:

performing a first water washing procedure on the magnesium alloy based composite;

performing a acid washing/degreasing procedure on the magnesium alloy based composite after the first water washing procedure;

performing a second water washing procedure on the magnesium alloy based composite after the acid washing/degreasing procedure;

performing a neutralizing procedure on the magnesium alloy based composite after the second water washing procedure;

performing a third water washing procedure on the magnesium alloy based composite after the neutralizing procedure;

performing a chemical oxidation procedure on the magnesium alloy based composite after the third water washing procedure;

performing a fourth water washing procedure on the magnesium alloy based composite after the chemical oxidation procedure; and performing a baking procedure on the magnesium alloy based composite after the fourth water washing procedure, to form the oxide film.

6. The surface treatment method of the magnesium alloy article according to claim 1, wherein the step of performing the hairline finish process on the magnesium alloy based composite further comprises:

performing a polishing procedure on the magnesium alloy based composite;

performing a first grinding procedure on the magnesium alloy based composite after the polishing procedure; and performing a second grinding procedure on the magnesium alloy based composite after the first grinding procedure, to form the hairline structure, wherein a grit size of an abrasive belt used in the first grinding procedure is relatively greater than that of an abrasive belt used in the second grinding procedure.

7. The surface treatment method of the magnesium alloy article according to claim 1, wherein after the first chemical oxidation process, the method further comprises performing at least one pass of lacquering process on the magnesium alloy based composite, to form at least one lacquer layer on the glossy film.

8. The surface treatment method of the magnesium alloy article according to claim 7, wherein after the lacquering process, the method further comprises performing an matting process on the magnesium alloy based composite, to form a matt film on the lacquer layer.

9. A surface treatment method of a magnesium alloy article, comprising:

providing a magnesium alloy based composite without a primer on a surface thereof;

performing a hairline finish process on the magnesium alloy based composite, to form at least one hairline structure on a surface of the magnesium alloy based composite; and performing a first chemical oxidation process on the magnesium alloy based composite, to form a glossy film covering the hairline structure on the surface of the magnesium alloy based composite, wherein the glossy film is defined as a surface protection film of the hairline structure, and is used for maintaining or increasing the glossiness of the surface of the magnesium alloy based composite;

wherein, the step of performing the first chemical oxidation process further comprises:

performing a degreasing procedure on the magnesium alloy based composite;

performing a first water washing procedure on the magnesium alloy based composite after the degreasing procedure;

performing a second water washing procedure on the magnesium alloy based composite after the first water washing procedure;

performing a chemical oxidation procedure on the magnesium alloy based composite after the second water washing procedure;

performing a third water washing procedure on the magnesium alloy based composite after the chemical oxidation procedure;

performing a deionized water washing procedure on the magnesium alloy based composite after the third water washing procedure; and performing a baking procedure on the magnesium alloy based composite after the deionized water washing procedure, to form the glossy film;

wherein before the hairline finish process, the method further comprises performing a second chemical oxidation process on the magnesium alloy based composite, to form an oxide film on the surface of the magnesium alloy based composite, and the hairline structure penetrates through the oxide film, and is formed on the surface of the magnesium alloy based composite.

10. The surface treatment method of the magnesium alloy article according to claim 9, wherein a difference between the glossiness of the magnesium alloy based composite formed with the glossy film and a magnesium alloy based composite without the glossy film is greater than or equal to zero.

11. The surface treatment method of the magnesium alloy article according to claim 10, wherein the difference between the glossiness of the magnesium alloy based composite formed with the glossy film and the magnesium alloy based composite without the glossy film is at least 0.7 gloss unit (GU).

* * * * *